United States Patent [19]

Utsumi

[11] 3,938,304

[45] Feb. 17, 1976

[54] WRAPPING DEVICE

[76] Inventor: Yoshikazu Utsumi, 47 Higashiura-cho Daigo Misasagi, Fushimi, Kyoto, Kyoto, Japan

[22] Filed: Aug. 27, 1973

[21] Appl. No.: 391,778

[30] Foreign Application Priority Data

July 19, 1973 Japan ..... 48-81500

[52] U.S. Cl. ..... 53/229

[51] Int. Cl.[2] ..... B65B 11/26

[58] Field of Search ..... 53/34, 221, 228, 229, 230, 53/231, 232, 233

[56] References Cited

UNITED STATES PATENTS

| | | | |
|---|---|---|---|
| 1,816,085 | 7/1931 | Langhammer | 53/231 X |
| 1,873,060 | 8/1932 | Smith | 52/230 |
| 2,146,997 | 2/1939 | Smith | 53/230 |
| 3,006,119 | 10/1961 | Fingerhut | 53/230 X |
| 3,035,379 | 5/1962 | Cloots | 53/34 X |
| 3,327,453 | 6/1967 | Willbrandt | 53/228 |
| 3,662,513 | 5/1972 | Fabbri | 53/34 X |

*Primary Examiner*—Travis S. McGehee
*Assistant Examiner*—John Sipos
*Attorney, Agent, or Firm*—Armstrong, Nikaido & Wegner

[57] ABSTRACT

A device for tightly wrapping objects is provided which includes suction boxes for holding the wrapping paper under tension as it is wrapped around the object. The holding of the wrapping paper using suction boxes permits the paper to be tightly tensioned around the object regardless of the smoothness of the surface of the wrapping paper. The wrapping paper is folded across the bottom of the object by cooperation between a plate means positioned under the object and the movement of holding means which holds the object.

2 Claims, 6 Drawing Figures

WRAPPING DEVICE

BACKGROUND OF THE INVENTION

1. Field of the Invention

The present invention relates to a wrapping device in which a wrapping material is wrapped tightly around a parallelepiped shape object first on the top, then on both sides and bottom thereof, whereby a neat appearance of wrapping can be obtained as a result of stabilization of the wrapping process and the tightness of the wrapping paper around the object can easily be adjusted.

2. Prior Art

In conventional wrapping devices of the same kind, the frictional force between the wrapping paper and the passageway is made greater than that between the wrapping paper and the object to obtain tight wrapping. However, this conventional wrapping system cannot always provide suitably tight wrapping if the wrapping paper differs in the quality and coating of its surface.

SUMMARY OF THE INVENTION

In the wrapping device of the present invention, since the object is tightly wrapped using suction of air, the frictional force between the wrapping paper and the material is in proportion to the air suction pressure. This ensures tight wrapping of the material even if, for example, the coefficient of friction is great between the object and the wrapping paper. Therefore, tight wrapping can constantly be obtained even if the wrapping paper differs in the quality and coating material thereof. Moreover, by changing the air suction pressure, the tightness of the wrapping paper to the wrapped material can easily be adjusted.

DETAILED DESCRIPTION OF THE DRAWINGS

PREFERRED EMBODIMENTS

Figure 1:
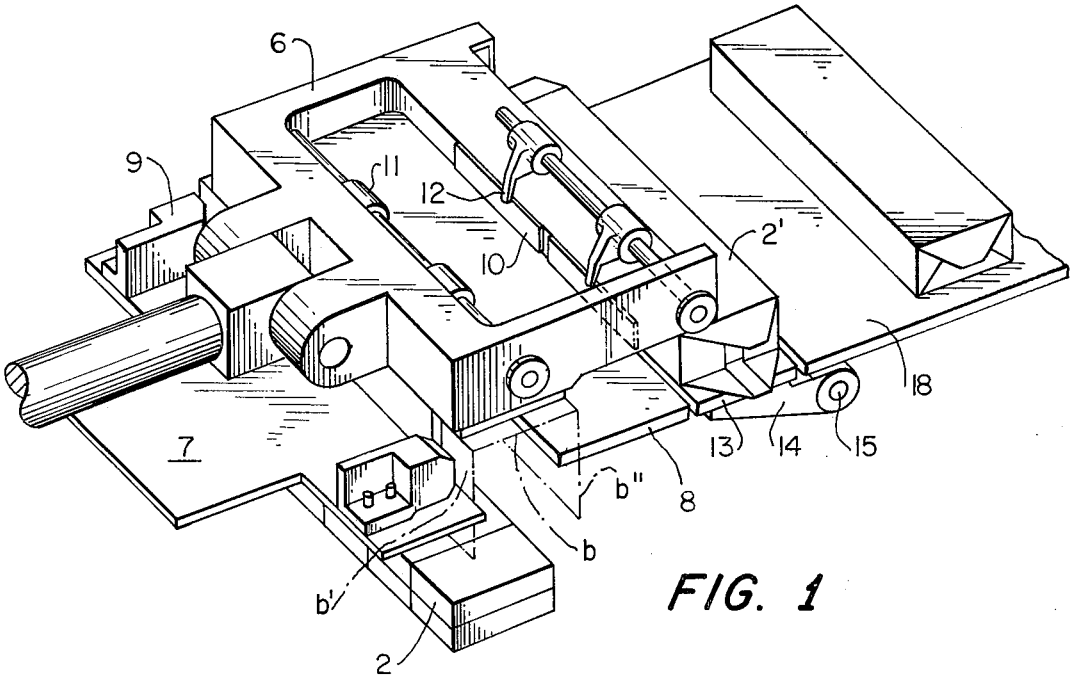
FIG. 1 is a perspective view of the preferred embodiment of the present invention.
Figure 2:
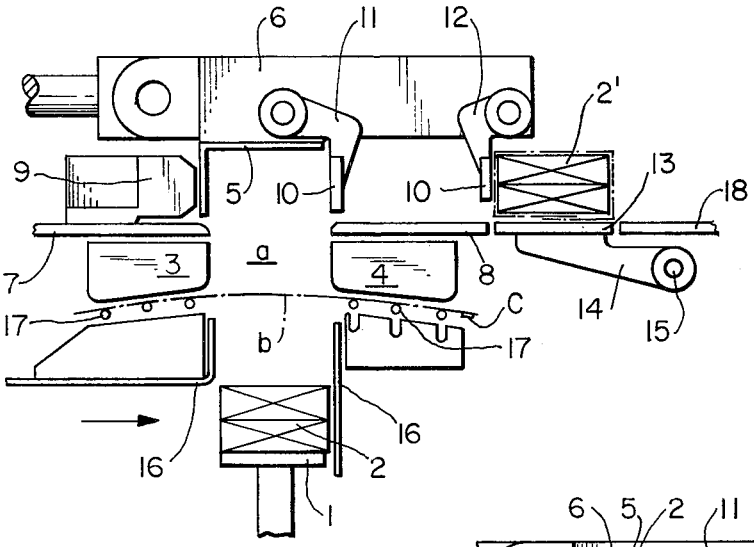
FIGS. 2–6 are views showing the relationship of the elements of the present invention during various stages of wrapping.

Referring to the figures, 1 is an elevatable pushing means which pushes an object or objects of parallelepiped shape such as ten cigarette packages arranged in two rows of five, one on top of the other. The pushing means 1 is pushed upwards through an upward wrapping material passageway *a*. Opposed air suction boxes 3, 4 are provided at both sides of the middle of said passageway *a*, these boxes 3, 4 respectively having many suction holes (not illustrated) on the surface facing said passageway *a*.

The air suction boxes 3, 4 are connected to a blower (not shown) through piping (not shown) so as to suck air from said boxes 3, 4. Opposed plates 7, 8 fold wrapping paper ends along the bottom of the objects over the air suction boxes 3, 4. The plate 7 has, on the upper surface adjacent its ends, means 9 for folding the vertical left-hand side ends of a wrapping paper along the sides of the object. Furthermore, over the material passageway *a*, an angled plate 5 is attached to a movable frame 6, the frame 6 reciprocating from side to side. Turning arms 11 and 12 positioned a distance apart are pivotally fitted at their base to the movable frame 6 facing in opposite directions. The arms 11 and 12 are provided with an object holding member 10.

A supporting plate 13 is provided adjacent the plate 8 for folding the wrapping paper ends along the bottom of the object so that both plates 8 and 13 are on the same level. A turning arm 14 under the supporting plate 13 is attached to a structure (not shown) by means of a pivot 15. 16 is an object feeding guide, and *b* is a wrapping paper. 17 are wrapping paper guides and 18 is a discharging guide for a wrapped object. C shows hot-melt adhesives attached to an end of the wrapping paper *b*.

The wrapping device of the present invention is further arranged to feed the wrapping paper *b* using delivery rolls (not shown), cut it to regular size by the use of cutter means (not shown) and pass it along the wrapping paper guides 17 to a predetermined position of the wrapped material passageway *a*, where it is elevated in fixed working cycle by means of the pushing means 1.

Figure 3:
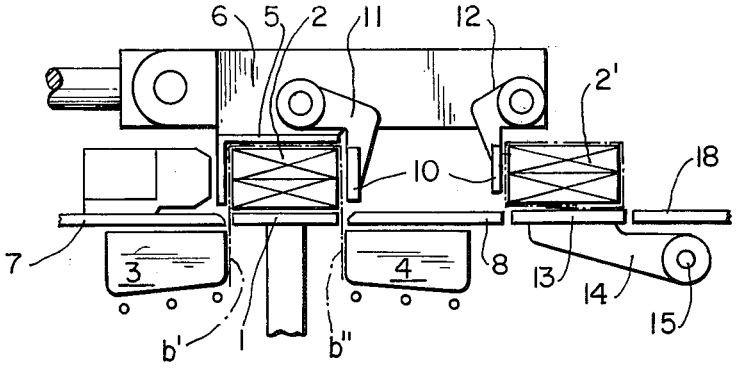
Figure 4:
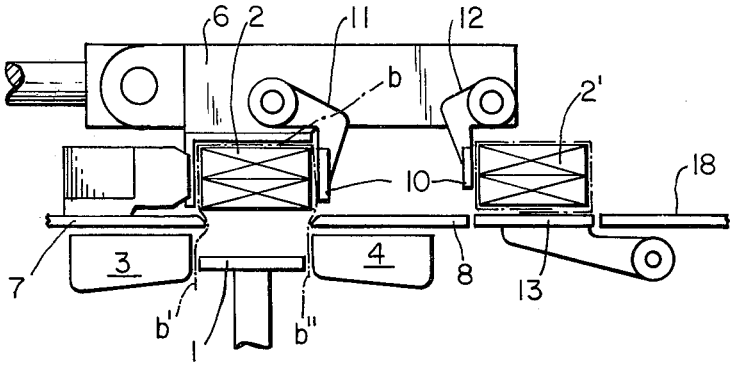
Figure 5:
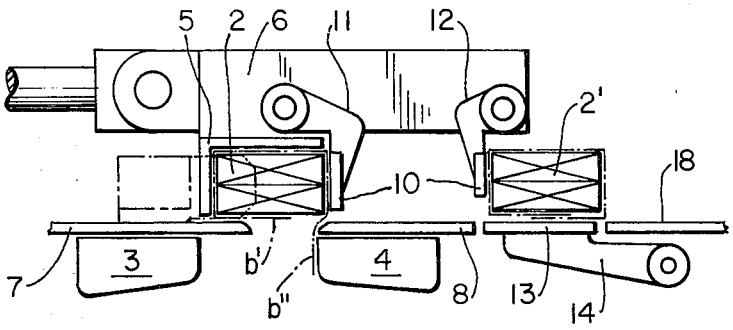
Figure 6:
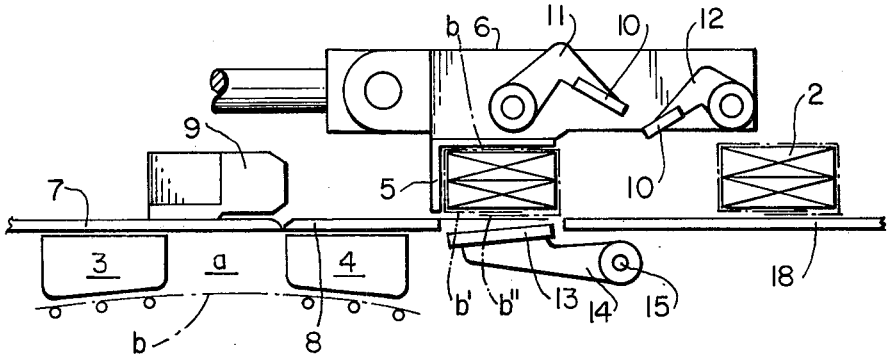
Figure 6:
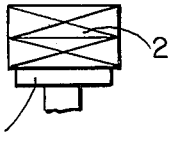

In operation, as illustrated in FIGS. 2–6, the objects 2 are intermittently transferred onto the pushing means 1 by the use of suitably-spaced means (not shown) and pushed upwards through the wrapped material passageway with the upward movement of the pushing means 1. Since the wrapping paper *b* is extended across the entrance of the passageway *a*, the object 2 has the wrapping paper *b* put on its surface and continues to rise through said passageway. In such elevating movement of the wrapped material, both ends of the wrapping paper *b* are brought into contact with the air suction boxes and folded down. The folded ends *b'*, *b''* adhere to the surface of the air suction holes of said boxes 3 and 4 by suction of air from said air suction holes as illustrated in FIG. 3. The folded ends *b'*, *b''* of the wrapping paper slide along the air suction surface of the suction boxes 3 and 4 as the object 2 is elevated further. Adherence of said ends *b'*, *b''* to the air suction surface of the boxes 3 and 4 is still continued after the object 2 has been pushed between the angled member 5 and the holding member 10 of the turning arm 11. Then the angle plate 5 is moved forward slightly to the right by means of the movable frame 6. As a result, the object 2 held between the angled plate 5 and the holding member 10 of the turning arm 11 is simultaneously moved to the right and the bottom of the object 2 rests slightly on the plate 8. At this point, the wrapping paper *b* on the object 2 is slightly folded at one end *b''* thereof as illustrated in FIG. 4. Subsequently, the plate 7 is moved slightly forward and the pushing means 1 starts to descend, until it returns to its initial position. The other end *b'* of the wrapping paper is folded along the bottom of the object 2 by the use of the tip of the plate 7 while, at the same time, the end *b''* of the wrapping paper is also folded along the bottom of the object as a result of the movement of the object over plate 8, as shown in FIG. 5. In this position, the movable frame 6 starts to advance, and the forward movement of the object 2 takes place with the object 2 held between the angled member 5 and the holding means 10 of the turning arm 11. This forward movement of the object 2 allows the end *b''* of the wrapping paper to be folded along the bottom of the object 2 by means of the plate 8. The folded end *b''* of the wrapping paper is lapped with the earlier folded end *b''* thereof. The folded ends *b'* and *b'* are then pasted up by means of adhesives C. When the object 2 is passed onto the supporting plate 13, the other turning arm 12 is operated to deliver it onto the discharging guide 18 as a wrapped object 2'.

The advancement of the movable frame 6 is stopped when the object is put on the supporting plate 13. In the above mentioned process, the wrapping paper is folded on the vertical end at the left hand side and in the horizontal upper and lower ends along the sides of the object by means (not shown), whereby the object is wrapped on its entire surface.

The turning arms 11 and 12 are turned when the object 2 is put on the supporting plate 13, and the holding member 10 of the turning arm 11 detaches from the object 2. Thereupon, the turning arm 14 rotates about the pivot 15 to remove the wrapped object 2 from the angled plate 5, and the angled plate 5 and the turning arms are returned to their initial positions immediately thereafter.

It will be understood that the respective operations are continuously repeated for complete wrapping of objects parallelepiped in shape.

In the present invention, a wrapping paper is put on the upper surface of an object when the object is pushed upwards through the material passageway *a*, and both ends *b'* and *b''* of the wrapping paper are attracted to the air suction boxes forming part of said passageway. As a result, the frictional force is increased between the air suction boxes and both ends *b'*, *b''* of the wrapping paper, while decreased substantially to zero between the object and the ends *b'* and *b''*. It is therefore to be noted that the wrapping paper is pulled to achieve tight wrapping of the object.

The present invention may be embodied in other specific forms without departing from the spirit or essential characteristics thereof. The presently disclosed embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. A device for tightly wrapping an object in a wrapping paper said device comprising a. pusher means for pushing said object such that the top of said object engages said wrapping paper and the ends of the wrapping paper extend below the object along the sides thereof;

b. suction means positioned below said object, after it has been pushed, for holding the ends of said wrapping paper such that said wrapping paper is tensioned over the top of said object;

c. plate means positioned over said suction means and below the level of the bottom of said object;

d. means to move one of said plate means relative to said object;

e. holding means for holding said object after said wrapping paper has been tensioned thereon as said plate means is moved and for moving said object relative to the other plate means whereby the wrapping paper is folded under the object, said holding means comprising an angle plate for engaging the top and one side of the object and a first turning arm means for engaging the other side of said object;

f. a second turning arm means positioned to engage the bottom of said object after it has been wrapped and while it is engaged by said holding means; and g. means for simultaneously turning said first and second turning arm means away from said object so that the bottom of said object remains in contact with said second turning arm means and is disengaged from said holding means.

2. A device as set forth in claim 1 wherein said plate means comprises a first plate positioned to the rear of said object which moves in the forward direction under said object while said holding means are stationary thereby folding one end of said wrapping paper under said object, and a second plate positioned to the front of said object which is stationary while said holding means moves in the forward direction thereby folding the other end of said wrapping paper under said object.

* * * * *